US007526877B2

(12) United States Patent
Kim et al.

(10) Patent No.: US 7,526,877 B2
(45) Date of Patent: May 5, 2009

(54) DRYING DEVICE AND METHOD THEREOF

(75) Inventors: Young Soo Kim, Changwon-si (KR); Soung Bong Choi, Changwon-si (KR); Byung Hwan Ahn, Gimhae-si (KR); Deug Hee Lee, Gimhae-si (KR); Hung Myong Cho, Gyeongsangnam-do (KR)

(73) Assignee: LG Electronics, Inc., Seoul (KR)

( * ) Notice: Subject to any disclaimer, the term of this patent is extended or adjusted under 35 U.S.C. 154(b) by 148 days.

(21) Appl. No.: 11/319,788

(22) Filed: Dec. 29, 2005

(65) Prior Publication Data

US 2006/0242856 A1 Nov. 2, 2006

(30) Foreign Application Priority Data

Dec. 30, 2004 (KR) ..... 10-2004-116155

(51) Int. Cl.
*F26B 21/06* (2006.01)
*F26B 25/06* (2006.01)

(52) U.S. Cl. ..... 34/209; 34/210; 34/212; 34/215; 34/73; 34/77; 34/566; 34/570

(58) Field of Classification Search ..... 34/72, 34/73, 76, 77, 86, 109, 127, 129, 131, 132, 34/595, 604, 607, 608, 196, 197, 201, 202, 34/209, 210, 212, 215, 219, 565, 566, 570; 219/483–486

See application file for complete search history.

(56) References Cited

U.S. PATENT DOCUMENTS

| | | | | |
|---|---|---|---|---|
| 3,256,616 | A * | 6/1966 | McGoldrick | 34/210 |
| 3,921,308 | A * | 11/1975 | Freze | 34/395 |
| 4,819,341 | A * | 4/1989 | Gayso | 34/86 |
| 5,796,076 | A * | 8/1998 | Azuma | 219/486 |
| 6,323,472 | B1 * | 11/2001 | Coleman | 219/685 |
| 6,907,680 | B2 * | 6/2005 | Mariotti | 34/486 |
| 6,928,752 | B2 * | 8/2005 | Johnson et al. | 34/127 |
| 2004/0154194 | A1 | 8/2004 | Prows | |
| 2004/0194339 | A1 | 10/2004 | Johnson et al. | |

FOREIGN PATENT DOCUMENTS

GB 2051330 A * 1/1981

* cited by examiner

*Primary Examiner*—Jiping Lu
(74) *Attorney, Agent, or Firm*—McKenna Long & Aldridge LLP

(57) ABSTRACT

An operation method for a drying device is disclosed. More particularly, the present invention relates to a new type of a drying device which enables air in a drying drum and a cabinet for drying the laundry to circulate continuously, as well as capable of getting a suitable output of power based on each drying cycle due to a various structure of a drying heater.

10 Claims, 7 Drawing Sheets

DRYING DEVICE AND METHOD THEREOF

This application claims the benefit of the Korean Patent Application No. P2004-116155, filed on Dec. 30, 2004, which is hereby incorporated by reference as if fully set forth herein.

BACKGROUND OF THE INVENTION

1. Field of the Invention

The present invention relates to a drying device, and more particularly, to a new type of a drying device which enables air to circulate continuously therein for drying the laundry and which can gain a suitable output of power for an operation of each cycle by varying a structure of a drying heater.

2. Discussion of the Related Art

In general, a dryer is an electric home appliance which can dry cloth items, cloths and beddings (hereinafter, 'the laundry'). The dryer has the laundry therein and dries the laundry by supplying hot air to the washed laundry continuously.

FIG. 1 illustrates a conventional tumble dryer out of related art dryers.

The related art tumble dryer includes a body 10, a drying drum 20, a door 40, a motor 50, a drying heater 60 and a fan 70.

The body 10 defines an exterior of the tumble dyer, and the drying drum 20 is rotatably mounted inside of the body 10.

Also, an opening 11 is formed in front of the body 10, and the door 40 is coupled for opening/closing the opening 11.

The motor 50 is secured to an inner downside of the body 10 for creating a driving force to rotate the drying. drum 20 and the fan 70.

The drying heater 60 is mounted on an inner portion of a hot air supply channel 91 for heating air flowing within the hot air supply channel 91. The hot air supply channel 91 guides a hot air passage supplied into the drying drum 20.

The fan 70 discharges dry air flowing inside of the drying drum 10 to an outside, and is provided in communication with a hot air discharge channel 92.

Thus, once the fan 70 is put into operation, external air is guided by the hot air supply channel 91 and heated by passing through the drying heater 60 to be drawn into the drying drum 10.

Thereby, the damp laundry introduced into the drying drum 10 is gradually getting dried by the heated external air.

The air having dried the laundry by being circulated within the drying drum 10 is guided by the hot air supplying channel 92 to be discharged outside.

Once drying is completed by the repeated performance of the above process, the fane 70 and the drying heater 60 are stopped to finish a drying cycle.

However, the related art tumble dryer has a problem that a tangled portion of the laundry is not dried smoothly, because the drying cycle is performed in a state of the laundry being introduced together at one time.

There is another problem that it is impossible to keep the laundry for a long time period in the related art tumble dryer.

Thus, recently demands have been increasing accordingly for a new type of a combination dryer having a drying capacity thereof enlarged as well as capable of keeping the laundry for a long time. There are various kinds of combination dryers provided with tumble dryers having auxiliary cabinet dryers provided therewith, for example, US Laid-open Patent Application No. 2004-0194339 A1 or US Laid-open Patent Application No. 2004-0154194 A1.

The above combination dryer has a cabinet dryer provided on a top of a conventional dryer having a rotatory drum. The cabinet dryer has space for the laundry and receives hot air used to dry or keep the laundry for a long time.

The cabinet dryer is employed to dry the laundry or keep the laundry therein for a long time after receiving hot air from the tumble dryer.

However, the combination dryer described above may cause a problem that the combination dryer cannot be supplied for being built-in, because the air having dried the laundry is discharged outside of the combination dryer.

That is, since space for being built-in should be formed large enough to maintain a sufficient distance with a wall for discharging air smoothly, a design of an exterior may deteriorate.

Furthermore, since the air discharged from the combination dryer is a high-temperature humid air, internal environment may not be the high temperature humid one which a user does not want.

Still further, since the related art combination dryer has only one drying heater for generating hot air, and the output of a drying heater needed for operating a tumble dryer and the output needed for operating a cabinet dryer are the same, there may be a problem of unnecessary electric consumption.

SUMMARY OF THE INVENTION

Accordingly, the present invention is directed to a drying device and a method thereof that substantially obviates one or more problems due to limitations and disadvantages of the related art.

An object of the present invention is to provide a drying device which enables air in a drying drum and a cabinet for drying the laundry to circulate continuously, as well as capable of getting a suitable output of power based on each drying cycle due to a various structure of a drying heater.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a drying device comprising a tumble dryer comprising a hot air supplying pipe having more than two drying heaters therein for guiding hot air inflow; and a cabinet dryer provided on a top of the tumble dryer, the cabinet dryer comprising a keeping part having the laundry therein and an air inlet pipe receiving hot air from the hot air supplying pipe.

The hot air supplying pipe comprises a fan for forcibly ventilating air within the hot air supplying pipe and an air condensing part.

The cabinet dryer further comprises an air outlet for guiding air discharged from the keeping part into the hot air supplying pipe.

The drying heaters of the tumble dryer are two, and the two drying heaters having the same output capacity of power are paralleled.

Also, the drying heaters of the tumble dryer are two, and the two drying heaters having a different output capacity of power are paralleled.

The drying heaters of the tumble dryer are two, and the two drying heaters having the same output capacity of power are connected so as to adjust linear output.

Also, the drying heaters of the tumble dryer are two, and the two drying heaters having a different output capacity of power are connected so as to adjust linear output.

The drying heaters of the tumble dryer are three, and the two drying heaters having the same output capacity of power are connected so as to adjust linear output and the other drying heater parallels the two drying heater.

A method of a drying device comprising steps of identifying if an operation object is a tumble dryer and/or a cabinet dryer; and controlling more than two drying heaters to selectively radiate heat based on the identified operation object.

At that time, all of the drying heaters are controlled to be on in case that the operation object is identified as a tumble dryer, and one of the drying heaters is controlled to be on in case that the operation object is identified as a cabinet dryer. Also, one of the drying heaters is controlled to be on in case that the operation object is identified as both of the tumble dryer and the cabinet dryer.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
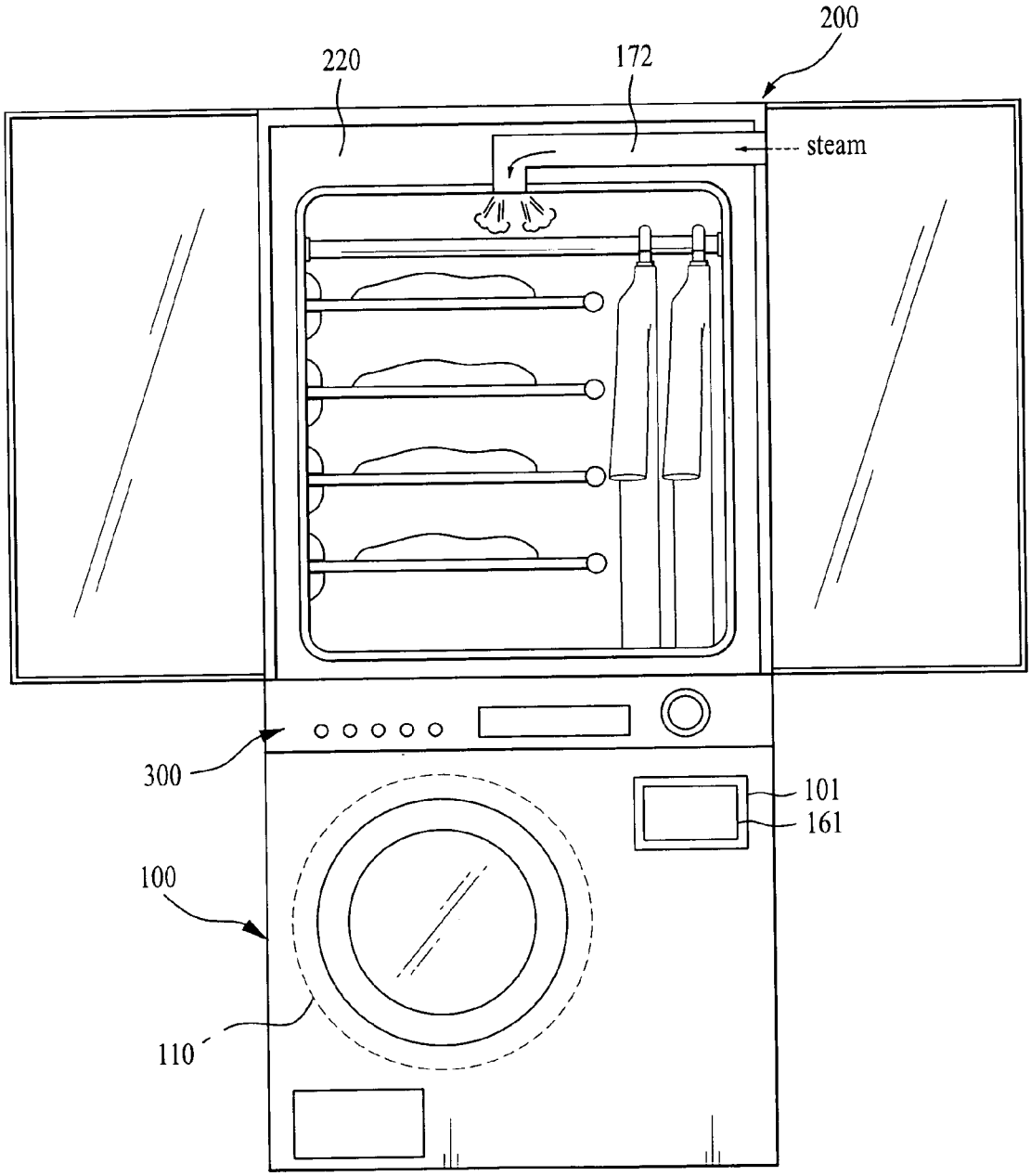
FIG. 1 is a diagram illustrating an inner structure of a conventional tumble dryer.
Figure 2:
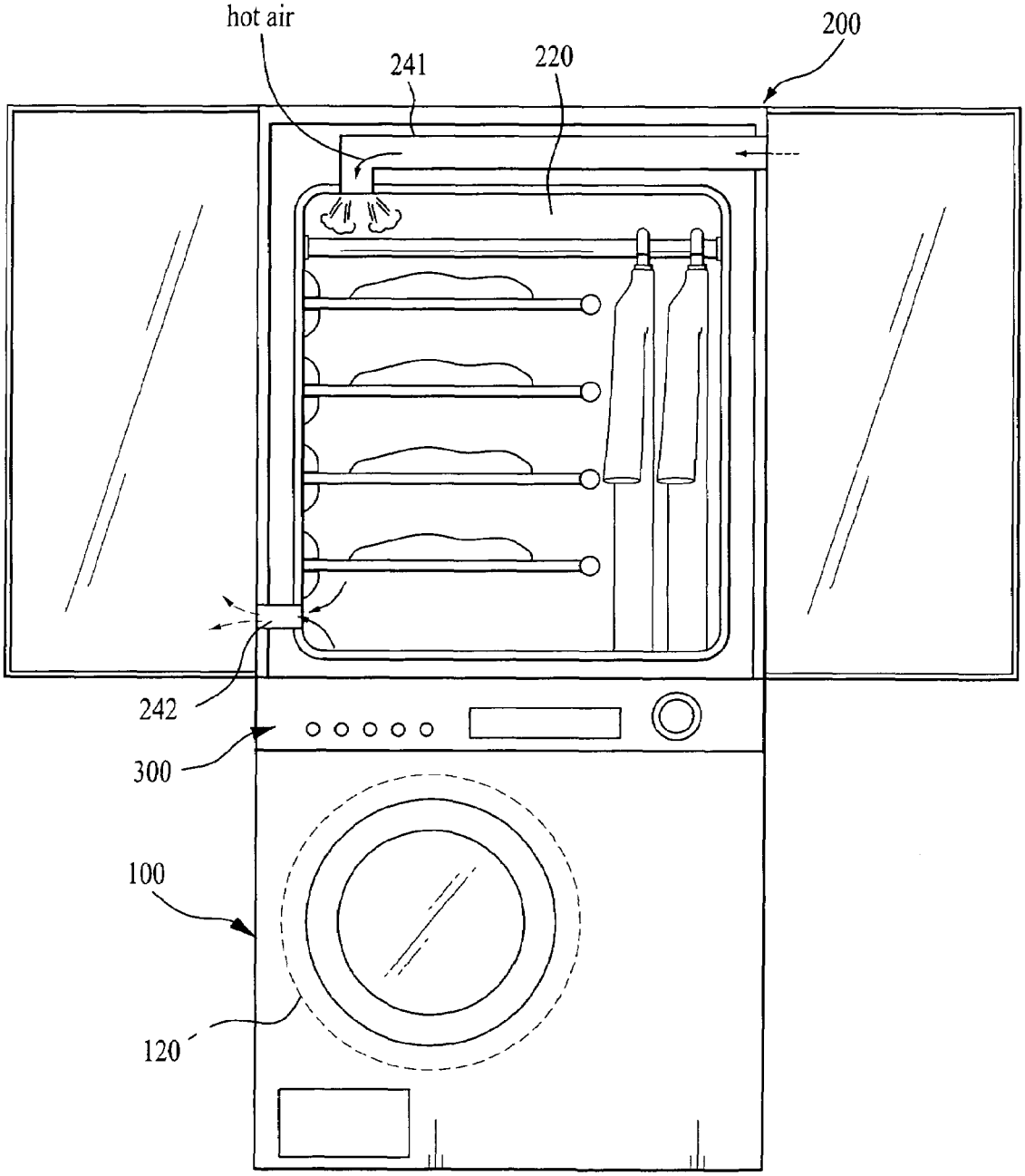
FIG. 2 is a diagram schematically illustrating an exterior of a drying device according to a first embodiment of the present invention.
Figure 3:
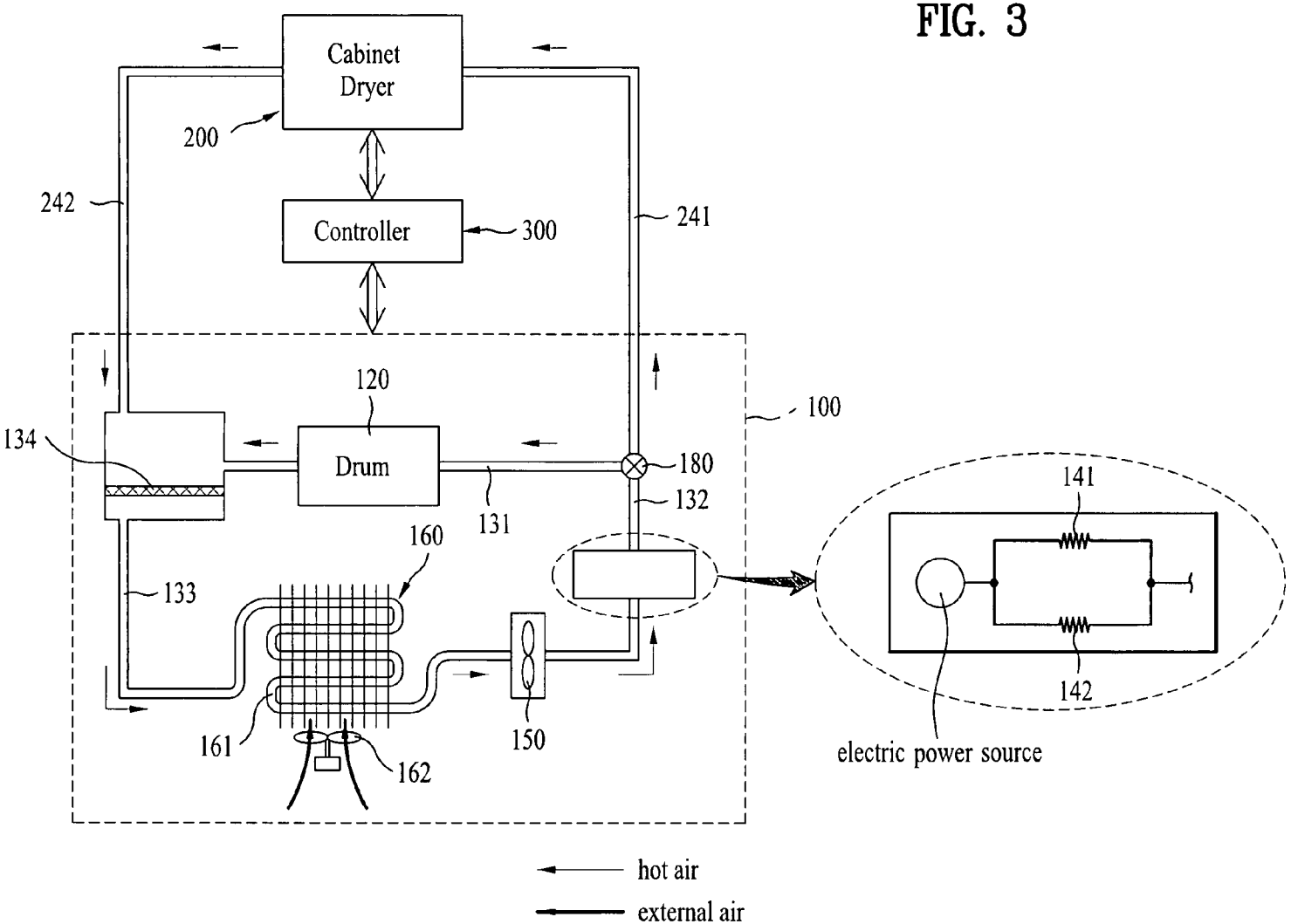
FIG. 3 is a block diagram schematically illustrating the drying device according to the first embodiment of the present.

As shown in FIGS. 2 to 3, a drying device according to a first embodiment of the present invention includes a tumble dryer 100, a cabinet dryer 200, and a controller 300.

The tumble dryer 100 performs only a drying cycle of the laundry. Hence, the tumble dryer 100 includes a drying drum 120 capable of rotating and agitating, a hot air supplying pipe 130 and more than two heaters 141 and 142.

The hot air supplying pipe 130 as a pipe guiding an inflow of high-temperature hot air is connectedly in communication with inside space among the drying drum 120, the air condensing part 160 and a cabinet dryer 200.

The hot air supplying pipe 130 includes a first supplying pipe 131 for supplying hot air into the drying drum 120, a second supplying pipe 132 for receiving and supplying the air having passed through the air condensing part 160 to the first supplying pipe 131, and a third supplying pipe 133 for receiving and transmitting the air discharged from the drying drum 120 to the air condensing part 160.

A filtering part 134 may be further provided in the third supplying pipe 133 for filtering foreign substances contained in the flowing air.

Also, the drying heaters 141 and 142 are provided within the second supplying pipe 132, and heats flowing air along the second supplying pipe 132.

The drying heaters 141 and 142 are two, and the drying heaters 141 and 142 having the same output capacity of power are paralleled each other.

For example, each drying heater has an output of 2700-watt. Also, the drying heaters are paralleled each other to have an output of 5400-watt at most.

Alternatively, the drying heaters 141 and 142 may be two, and may be paralleled each other to have a different output capacity.

For example, one drying heater 141 may have an output of 3000-watt and the other drying heater 142 may have an output of 2400-watt, thereby having the maximum output of 5400-watt.

On the other hand, the tumble dryer according to the first embodiment of the present invention further includes a fan 150 and an air condensing part 160.

The fan 150 is provided within the second supplying pipe 132 for forcibly ventilating the air within the second supplying pipe 132.

The air condensing part 160 condenses the air flowing along the hot air supplying pipe to radiate heat of the air. The air condensing part 160 includes a condenser 161 and a condensing fan 162.

The condenser 161 receives the hot air from the third supplying pipe 133, and includes a pipe having a plurality of branched portions and a cooling pin.

The condensing fan 162 ventilates external air toward the condenser 161.

Thus, the humid air passing through the condenser 161 is condensed through heat-exchanging with external air supplied by driving of the condensing fan 162, while flowing along a pipe way of the condenser 161.

The cabinet dryer 200 is mounted on a top of the tumble dryer 100, with a keeping part 220 having lots of the laundry kept therein.

The cabinet dryer 200 includes a hot air inlet pipe 241, and an air outlet pipe 242.

A first end of the hot air inlet pipe 241 is connected to an air outlet of the second supplying pipe 132, and a second end thereof is connectedly in communication with the keeping part 220 for transmitting hot air from the second supplying pipe 132 into the keeping part 220.

Preferably, an air channel valve 180 may be further provided in the second supplying pipe 132 for selectively guiding a direction of air flowing into the first supplying pipe 131 and/or the hot air inlet pipe 241.

Also, a first end of the air outlet pipe 242 is in communication with the keeping part 220, and a second end thereof is connected to the third supplying pipe 133 to discharge high-temperature humid air having passed through the laundry within the keeping part 220.

At that time, an auxiliary exhaustion fan (not shown) may be further provided in the air outlet pipe 242.

The controller 300 according to the first embodiment of the present invention controls operations of the tumble dryer 100 and the cabinet dryer 200.

At that time, the controller 300 may be provided in at least one of the tumble dryer 100 and the cabinet dryer 200, and it is preferred but not necessary that the controller 300 is provided only in the tumble dryer 100 as shown in embodiments of the present invention.

Figure 4:
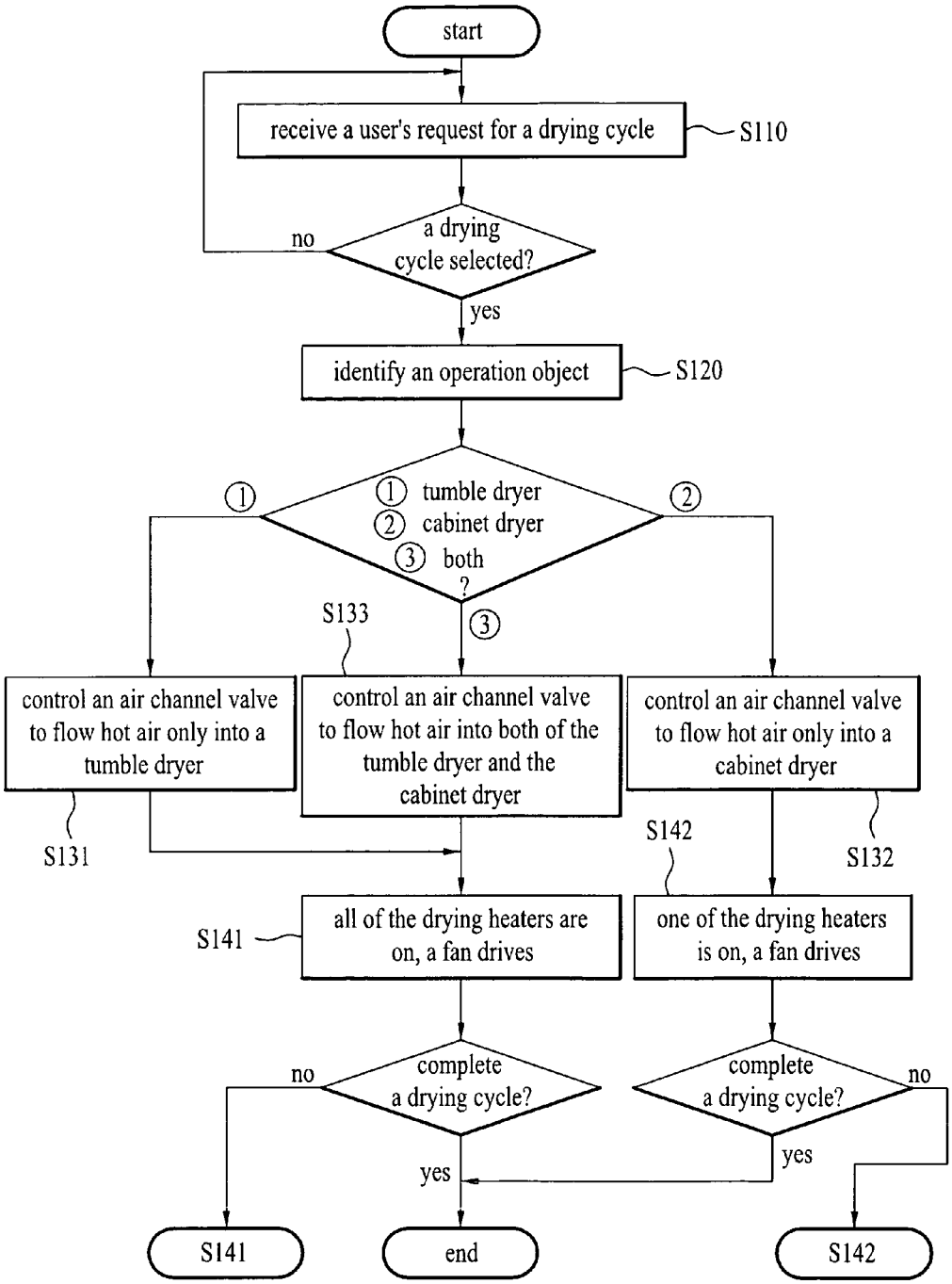
FIG. 4 is a flow chart schematically illustrating a controlling process of the drying device according to the first embodiment of the present invention.

Referring to a flow chart of FIG. 4, a controlling process of a drying device according to the first embodiment of the present invention will be described.

First, the controller 300 consistently receives a user's request for a drying cycle (S110).

Once a drying cycle is requested by the user through the controller 300, the controller 300 identifies an operation object of the drying cycle (S120).

The operation object is the tumble dryer 100 and/or the cabinet dryer 200.

Next, the controller 300 controls the air channel valve 180 to open only a pipe connected with the identified operation object (S131, S132 and S133).

Hence, the controller 300 controls a pair of drying heater 141 and 142 to generate hot air.

Especially, the pair of the drying heaters 141 and 142 is controlled to radiate heat differently based on the operation object.

For example, once the operation object is identified as the tumble dryer 100 or as a simultaneous operation of the tumble dryer 100 and the cabinet dryer 200, the controller 300 controls the pair of the drying heaters 141 and 142 to be on (S141) for gaining the maximum output of 5400-watt. Thereby, a smooth drying cycle is possible.

In case that the operation object is identified as the cabinet dryer 200, only one drying heater 141 is controlled to be on (S141) for gaining a relatively small output of 2700-watt.

That is why the operation of the cabinet dryer 200 is not for an actual drying cycle, but for a refreshing or a laundry keeping. That is, only one drying heater is on, because the operation temperature may be lower than the operation temperature for drying the laundry.

Also, as described above, due to the selective radiation of each drying heater 141 and 142, the temperature within the second supplying pipe 132 maintains high.

At that time, since the fan 150 drives, air within each pipe 131, 132 and 133 of the hot air supplying pipe 130 is forcibly ventilated.

The hot air changed hot by the drying heaters 141 and 142 is flown along each hot air supplying pipe 131, 132 and 133 to be consistently supplied into the drying drum 120 of the tumble dryer 100 and/or the keeping part 220 of the cabinet dryer 200.

During the above series of the processes, the condensing fan 162 drives to enhance a condensing efficiency of air flowing along the condenser 161.

Hence, humid air drawn from the drying drum 120 and/or the keeping part 220 passes through the air condensing part 160 to remove moisture and to become dry air. Thereby, drying efficiency may be enhanced.

Thus, the laundry is dried by repetition of air inflow for a predetermined period of time.

On the other hand, the drying heaters 141 and 142 of the drying device according to each embodiment of the present invention are not defined only to be paralleled two structures.

That is, the drying heaters 141 and 142 are configured to be two. The two drying heaters 141 and 142 have the same output capacity of power and may be connected so as to adjust linear output.

Figure 5:
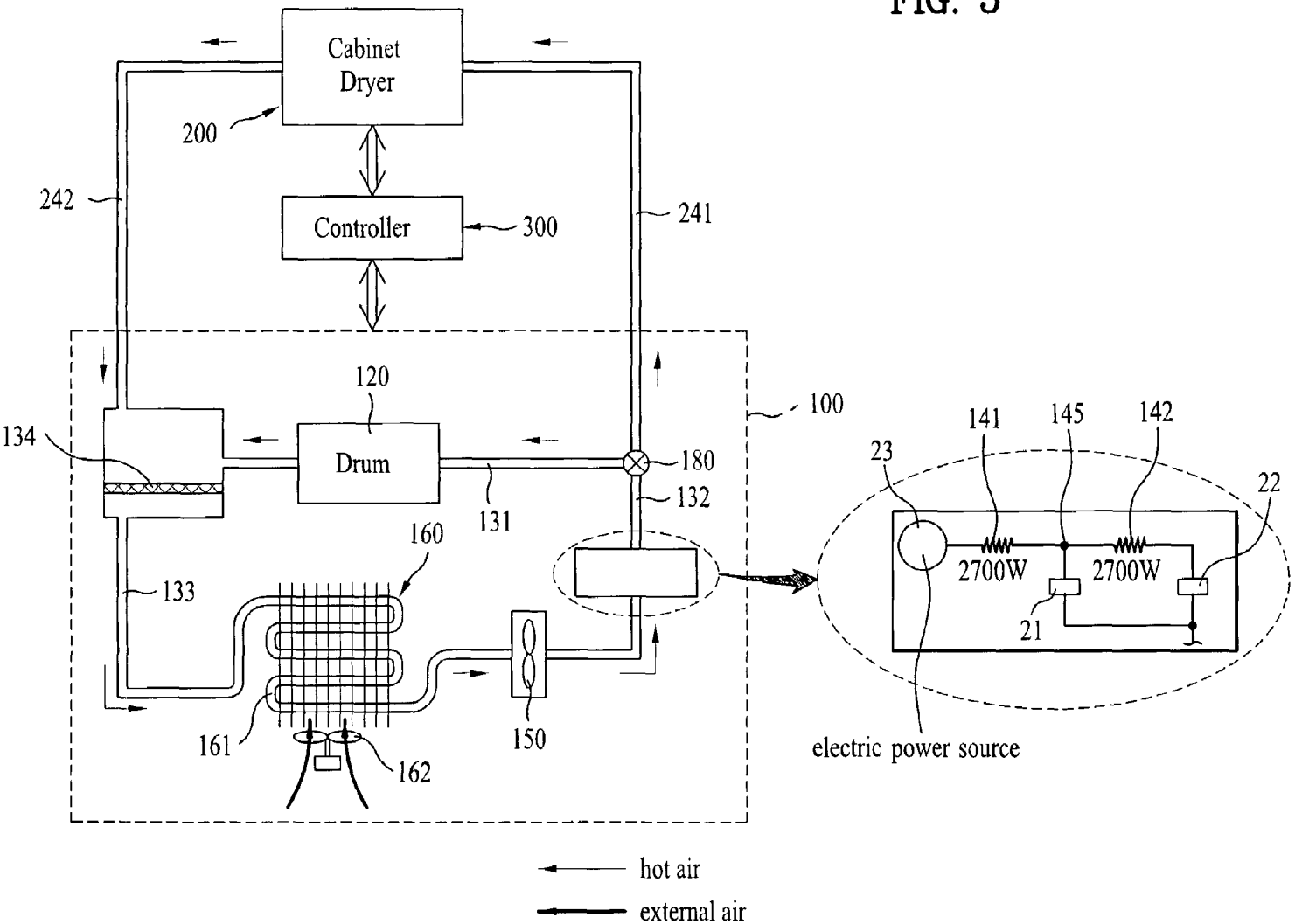
FIG. 5 is a block diagram schematically illustrating a drying device according to a second embodiment of the present invention.

That is possible, because the drying heaters 141 and 142 are paralleled and a tap 145 is provided at a connecting portion between the two drying heaters 141 and 142 as well as an output end of the drying heater 142 provided in rear, as shown in FIG. 5 illustrating a second embodiment of the present invention.

Power is selectively supplied to one drying heater 141 or both of the drying heaters 141 and 142 by the tap 145 to enable linear output adjusted.

Reference numbers 21 and 22 not described are relays, and a reference number 23 is an electric power source.

Alternatively, each drying heater 141 and 142 may have a different output capacity and may be connected so as to adjust linear output.

Figure 6:
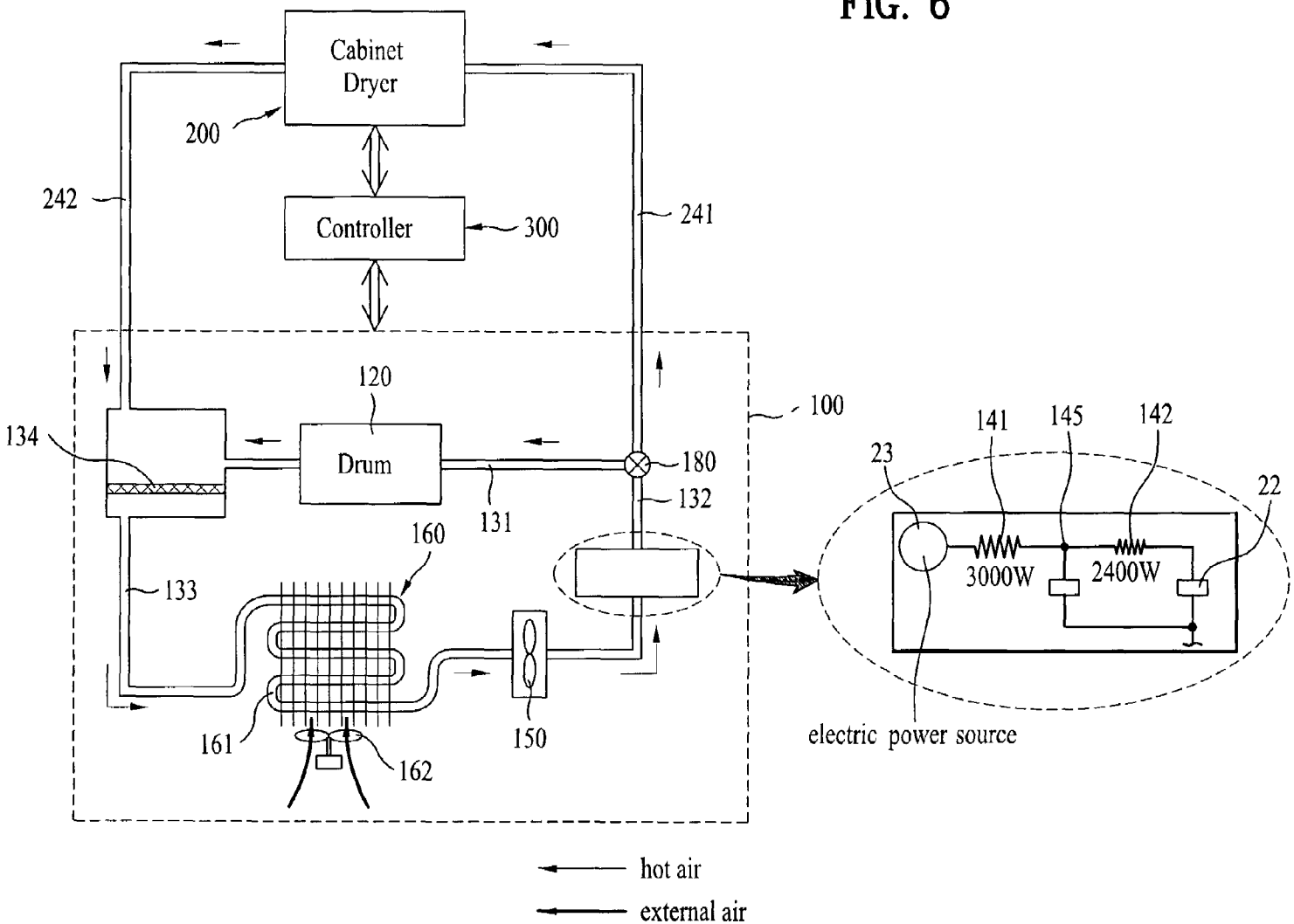
FIG. 6 is a block diagram schematically illustrating a drying device according to a third embodiment of the present invention.

For example, as shown in FIG. 6 illustrating a third embodiment of the present invention, one drying heater 141 has an output of 3000-watt and the other drying heater 142 has an output of 2400-watt.

Preferably, the drying heater 142 having the output of 3000-watt is connected with a power-applying end.

Figure 7:
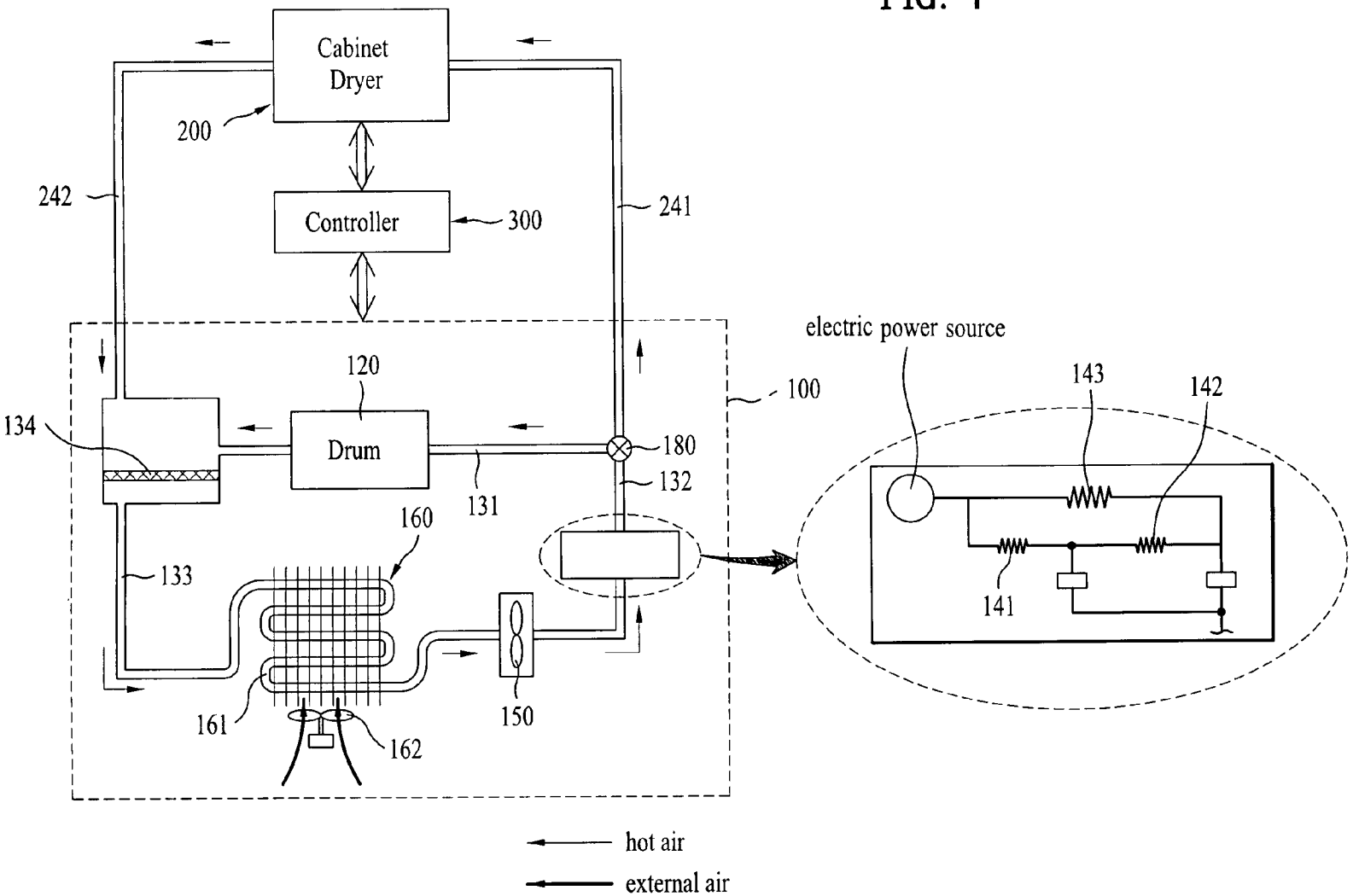
FIG. 7 is a block diagram schematically illustrating a drying device according to a fourth embodiment of the present invention.

Referring to FIG. 7, a fourth embodiment of the present invention will be described.

According to the fourth embodiment of the present invention, three drying heaters 141, 142 and 143 are provided. The two of the drying heaters 141 and 142 (hereinafter, referred to as a first drying heater and a second drying heater) are connected so as to adjust linear output. The other drying heater 143 (hereinafter referred to as a third drying heater) parallels the first and second drying heater 141 and 142.

The first drying heater 141 and the second drying heater 142 may be formed to have the same output capacity of power or to have different output capacity of power.

Preferably, the entire output capacity of the first and second drying heater 141 and 142 is the same as that of the third drying heater 143.

As described before, the operation process of the drying device through controlling the drying heater according to the second to fourth embodiments of the present invention is the same as the operation process according to the first embodiment of the present invention.

Therefore, the drying device according to each embodiment of the present invention has an industrial effect that inner environment may not be changed to be suitable for being built-in, because air flowing within the tumble dryer and the cabinet dryer is not discharged outside but continuously circulated.

Furthermore, the drying device according to each embodiment of the present invention has another industrial effect of enhancing drying efficiency, because the circulated air has its moisture removed smoothly due to the condensing part.

Still further, the drying device according to each embodiment of the present invention has another industrial effect of preventing unnecessary power loss due, because there are more than two drying heaters having selective output capacity of power, thereby getting each operation object to have suitable output in the drying cycle.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A drying device comprising:

a controller adapted to collectively operate an air channel valve, a tumble dryer, and a cabinet dryer;

the tumble dryer comprising a drum, a hot air supplying pipe, which is operationally in communication with the cabinet dryer, and at least two drying heaters, which heat air for use in both the tumble dryer and the cabinet dryer;

the cabinet dryer provided on a top of the tumble dryer, the cabinet dryer comprising;

a keeping part defining a space for laundry therein, a hot air inlet pipe for receiving hot air from the hot air supplying pipe, and an air outlet pipe for guiding air discharged from the keeping part into the hot air supplying pipe;

wherein the air channel valve selectively guides a direction of air flowing from the hot air supplying pipe to the drum of the tumble dryer, the keeping part of the cabinet dryer, or both the drum and the keeping part.

2. The drying device of claim 1, wherein the hot air supplying pipe comprises a fan for forcibly ventilating air within the hot air supplying pipe.

3. The drying device of claim 2, wherein the hot air supplying pipe further comprises an air condensing part.

4. The drying device of claim 1, wherein the drying heaters of the tumble dryer are two, and the two drying heaters having the same output capacity of power are paralleled.

5. The drying device of claim 1, wherein the drying heaters of the tumble dryer are two, and the two drying heaters having a different output capacity of power are paralleled.

6. The drying heater of claim 1, wherein the drying heaters of the tumble dryer are two, and the two drying heaters having the same output capacity of power are connected so as to adjust linear output.

7. The drying device of claim 1, wherein the drying heaters of the tumble dryer are two, and the two drying heaters having a different output capacity of power are connected so as to adjust linear output.

8. The drying device of claim 1, wherein the drying heaters of the tumble dryer are three, and the two drying heaters having the same output capacity of power are connected so as to adjust linear output and the other drying heater parallels the two drying heater.

9. The drying device of claim 1, wherein the at least two drying heaters are provided within the hot air supplying pipe.

10. The drying device of claim 1, wherein the drum of the tumble dryer receives hot air from the hot air supplying pipe and the keeping part of the cabinet dryer receives hot air from the hot air inlet pipe.

* * * * *